US005355203A

United States Patent [19]

Nishikawa et al.

[11] Patent Number: 5,355,203

[45] Date of Patent: Oct. 11, 1994

[54] HEAT ROLL FIXING UNIT WITH UNIFORM HEAT DISTRIBUTION

[75] Inventors: Tomoyuki Nishikawa, Matsudo; Masahiro Kita, Tokyo, both of Japan

[73] Assignee: Asahi Kogaku Kogyokabushiki Kaisha, Tokyo, Japan

[21] Appl. No.: 103,164

[22] Filed: Aug. 6, 1993

Related U.S. Application Data

[63] Continuation of Ser. No. 775,545, Oct. 15, 1991, abandoned.

[30] Foreign Application Priority Data

Oct. 15, 1990 [JP] Japan ..... 2-107804[U]
Oct. 15, 1990 [JP] Japan ..... 2-107805[U]

[51] Int. Cl.[5] ..... G03G 15/20
[52] U.S. Cl. ..... 355/285; 219/216
[58] Field of Search ..... 355/282, 285, 289, 290, 355/311; 432/60; 219/216

[56] References Cited

U.S. PATENT DOCUMENTS

| | | | |
|---|---|---|---|
| Re. 31,891 | 5/1985 | Tickner et al. | 355/75 |
| 3,884,623 | 5/1975 | Slack | 432/60 |
| 4,019,024 | 4/1977 | Namiki | 432/60 X |
| 4,365,139 | 12/1982 | Dannat | 219/216 |
| 4,594,068 | 6/1986 | Bardutzky et al. | 432/60 |
| 4,595,274 | 6/1986 | Sakurai | 219/216 X |
| 4,618,240 | 10/1986 | Sakurai et al. | 219/216 X |
| 4,801,968 | 1/1989 | Kogure et al. | 219/216 X |
| 4,825,242 | 4/1989 | Elter | 219/216 X |
| 4,897,675 | 1/1990 | Negishi | 346/154 |
| 5,041,718 | 8/1991 | d'Hondt et al. | 219/216 X |
| 5,053,806 | 10/1991 | Haigo et al. | 355/285 X |

*Primary Examiner*—Leo P. Picard
*Assistant Examiner*—Christopher Horgan
*Attorney, Agent, or Firm*—Sandler Greenblum & Bernstein

[57] ABSTRACT

In a fixing device employed in an electrophotographic imaging apparatus for fusing an unfixed toner image carrier on a recording sheet, a heat roller and a back-up roller are provided. The heat roller is provided with a heater mechanism installed therein, wherein the heater mechanism is arranged such that the temperature of a portion of the heat roller corresponding to the passing area of the recording sheet is higher than that of the other portions of the heat roller so that the temperature distribution of the heat roller heated by the heater mechanism becomes substantially uniform along its axial direction while the recording sheet is passing through the nip between the heat roller and the back-up roller.

15 Claims, 5 Drawing Sheets

HEAT ROLL FIXING UNIT WITH UNIFORM HEAT DISTRIBUTION

This application is a continuation of application Ser. No. 07/775,545, filed Oct. 15, 1991, now abandoned.

BACKGROUND OF THE INVENTION

The present invention relates to an heat roll fixing device employed in an electrophotographic imaging apparatus.

Conventionally, an electrophotographic imaging apparatus, such as a copy machine, laser beam printer and the like, is known wherein the uniformly charged surface of a photoconductive drum is exposed to light to form a latent image, charged toner is adhered to the latent image and developed to a toner image, and the toner image is then transferred onto a recording sheet and fixed thereon by a fixing device.

The electrophotographic imaging apparatus generally uses a so-called heat roll fixing device which heats, and pressingly fuses the toner image transferred on the recording sheet with the heat applied from a heated roller (heat roller) then fixes the same on the recording sheet. The heat roll fixing unit comprises a pair of fixing rollers composed of a heat roller and a press roller (also referred to as a back-up roller). The heat roller is composed of a cylindrical roller having a heating element, such as a halogen lamp or the like, inserted therein and heated to a predetermined temperature. The back-up roller is formed of a material, such as silicone rubber, having a heat resistant property and a predetermined elasticity and pressed against the heat roller by a predetermined pressure. The recording sheet carrying an unfixed toner image is caused to pass between the pair of fixing rollers to make the toner image to be heated and pressed so that the toner is fused and fixed on the recording sheet. This kind of the heat roll fixing device is advantageous in that it has an excellent heat efficiency and the fixing operation can be performed at a high speed.

The heat roller is controlled by feedback and thus kept at a temperature suitable for a fixing operation at all times. Usually, the heat roller is driven to rotate and then the back-up roller is rotated by the rotation of the heat roller; thus a recording sheet held between the pair of fixing rolls is fed by the fixing device (i.e., the pair of fixing rollers).

Nevertheless, the fixing device described above has a drawback in that the temperature of the back-up roller is irregularly distributed depending upon the width of a recording sheet to be subjected to a fixing operation. Thus, the back-up roller is irregularly expanded and deformed by the irregular temperature distribution, so that the fixing property and recording sheet feed capability of the fixing rollers are deteriorated.

More specifically, as shown in FIG. 1A, the temperature of the portion of the fixing device where a fixing operation is carried out (the portion contacting a recording sheet 20) is lowered because the heat of the portion is absorbed by the recording sheet 20 and the heat of the portion thereof where the fixing operation is not carried out is not absorbed by the recording sheet 20, and thus the temperature of a heat roller 11 in the axial direction thereof is irregularly distributed. Since an elastic material constituting a back-up roller generally has a large coefficient of thermal expansion, and since the heat of the back-up roller 12 in the axial direction thereof is also irregularly distributed in correspondence to the above irregular temperature distribution of the heat roller 11, the outside diameter of the portion in the axial direction thereof where the fixing operation is not carried out (the portion where the recording sheet does not contact) is enlarged and as shown in FIG. 1B, only the portion of the back-up roller where the recording sheet does not contact is pressed by the heat roller 11. (Note that any one of the heat roller 11 and the back-up roller 12 can be moved in the direction perpendicular to the axial direction thereof and urged toward another roller by an urging member, such as a spring, to provide a predetermined pressure and also note that FIG. 1B is exaggeratively drawn). As a result, a pressing force applied to the portion which contribute to the fixing operation is lowered and thus the fixing property and recording sheet feed capability are deteriorated. This problem arises more often when using a recording sheet having a width that is considerably narrower than the maximum width of a recording sheet which can be fixed with the fixing device (in other words, when a recording sheet having the width far narrower than the length of the heat roller is subjected to a fixing operation).

Further, the surface of the heat roller is finished to have a lower friction coefficient in order to prevent the adhesion of toner, and thus the feed of the recording sheet solely depends upon the back-up roller. With the arrangement that the back-up roller is rotated by the rotation of the heat roller, however, if the outside diameter of the portion of the back-up roller where the recording sheet contacts (the portion which contributes to the fixing operation of the loaded recording sheet) is made relatively smaller than that of the portion where the recording sheet does not contact the recording sheet, the circumferential speed of the back-up roller becomes smaller than a set value, thereby the feed speed of the recording sheet is lowered. As a result, if a recording sheet is a continuous paper or the like and there is provide a recording sheet feed mechanism in addition to the heat roll fixing device, the recording sheet feed speed thereof is not synchronized between the additional feed mechanism and the fixing unit, and the recording sheet may become loosened or jammed.

Further, since the heat roller has an irregular temperature distribution in the axial direction thereof which is caused by the width of a recording sheet, a temperature sensor for controlling the heat roller by feedback is preferably disposed to measure the temperature of the portion of the heat roller where the fixing operation is carried out. Even if, however, the temperature of the fixing portion is correctly measured, the temperature of the portion of the heat roller where the recording sheet does not contact (the portion through which the recording sheet does not pass) continuously increases to a high temperature and thus may adversely affect peripheral components and units.

SUMMARY OF THE INVENTION

It is therefore an object of the present invention to provide an improved heat roll fixing device in which the irregular temperature distribution of a back-up roller and the deterioration of the fixing property are prevented so that the recording sheet feeding capability is improved.

For the above object, according to the present invention, there is provided a fixing device comprising a heat roller and a back-up roller, employed in an electrophotographic imaging apparatus, for fusing an unfixed toner image carried on a recording sheet. The heat roller is provided with a heater mechanism installed therein, wherein the heater mechanism is arranged in such a fashion that the temperature of the portion corresponding to the passing area of the recording sheet is higher than that of the other portions so that the temperature distribution of the heat roller heated by the heater mechanism becomes substantially uniform along the axial direction while the recording sheet is passing between the heat roller and the back-up roller.

Optionally, the recording sheet is arranged to pass through the axial center portion of the fixing device wherein the temperature of the axial center portion of the heater mechanism is set higher than the temperature of both axial end portions thereof.

Further, the heating mechanism comprises a halogen lamp extending in the axial direction of the heat roller. The lamp is being provided with a heat generating element therein which is arranged to be dense at the axial end portions while sparse at the axial central portion.

Further, the heating mechanism may include a plurality of heating elements arranged in parallel in the axial direction of the heat roller, wherein the heating elements are arranged to partially heat predetermined axial areas, respectively.

Furthermore, the heating mechanism may also include at least a pair of heating elements arranged in parallel in the axial direction of the heat roller, wherein one of the heating elements is arranged to heat the axial center portion of the heat roller while the other one is arranged to heat the axial end portions.

According to another aspect of the invention, there is provided a fixing device comprising a heat roller and a back-up roller, employed in an electrophotographic imaging apparatus, for fusing an unfixed toner image carried on a recording sheet. The heat roller is provided with a heater mechanism installed therein, the fixing device is able to load various types of recording sheets having different widths.

The heater mechanism includes a plurality of heating elements arranged in parallel in the axial direction of the heat roller. The heating elements are arranged to partially heat the predetermined axial areas, respectively, so that the temperature of the portion corresponding to the passing area of the recording sheet can be made higher than that of the other portions by selectively functioning the plurality of heating elements depending upon the width of the recording sheet being loaded.

As such, the temperature distribution of the heat roller heated by the heater mechanism becomes substantially uniform in its axial direction while the recording sheet is passing between the heat roller and the back-up roller, regardless of the type of the recording sheet to be loaded.

Optionally, the fixing device further comprises:

a detecting mechanism for detecting the width of the recording sheet loaded; and a selecting mechanism for selecting the heating elements to be functioned depending upon the result of detection by the detecting mechanism.

Further, the detecting mechanism may comprise a pair of guide members arranged in parallel in the feed direction of the recording sheet, the interval between the guide members being varied in accordance with the width of the recording sheet loaded.

According to still another aspect of the present invention, there is provided a fixing device comprising a heat roller and a back-up roller, employed in an electrophotographic imaging apparatus, for fusing an unfixed toner image carried on a recording sheet. The heat roller is provided with a heater mechanism installed therein, and the fixing device is able to load at least two types of recording sheets having different widths.

The heater mechanism includes at least a pair of heating elements arranged in parallel in the axial direction off the heat roller wherein one of the heating elements being is arranged to partially heat the principal portion of the heat roller corresponding to the passing area of a predetermined type of recording sheet, while the other one is arranged to heat the remaining portions; and wherein the other one of the heating elements functions only when the recording sheet loaded is other than the predetermined type of recording sheet.

DESCRIPTION OF THE ACCOMPANYING DRAWINGS

DESCRIPTION OF THE EMBODIMENTS

Figure 1A:
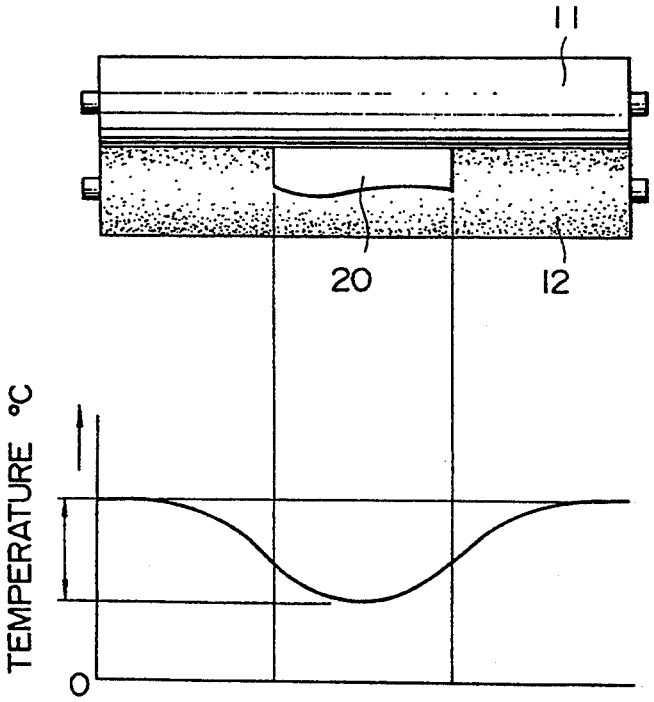
FIG. 1A PRIOR ART
FIGS. 1A and 1B are diagrams explaining the problem of a conventionally arranged heat roll fixing device.
Figure 1B:
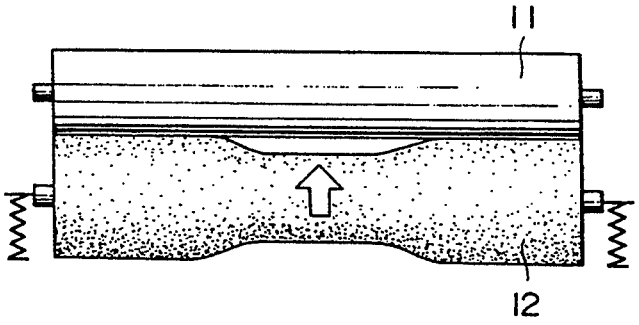
FIG. 1B PRIOR ART
Figure 2:
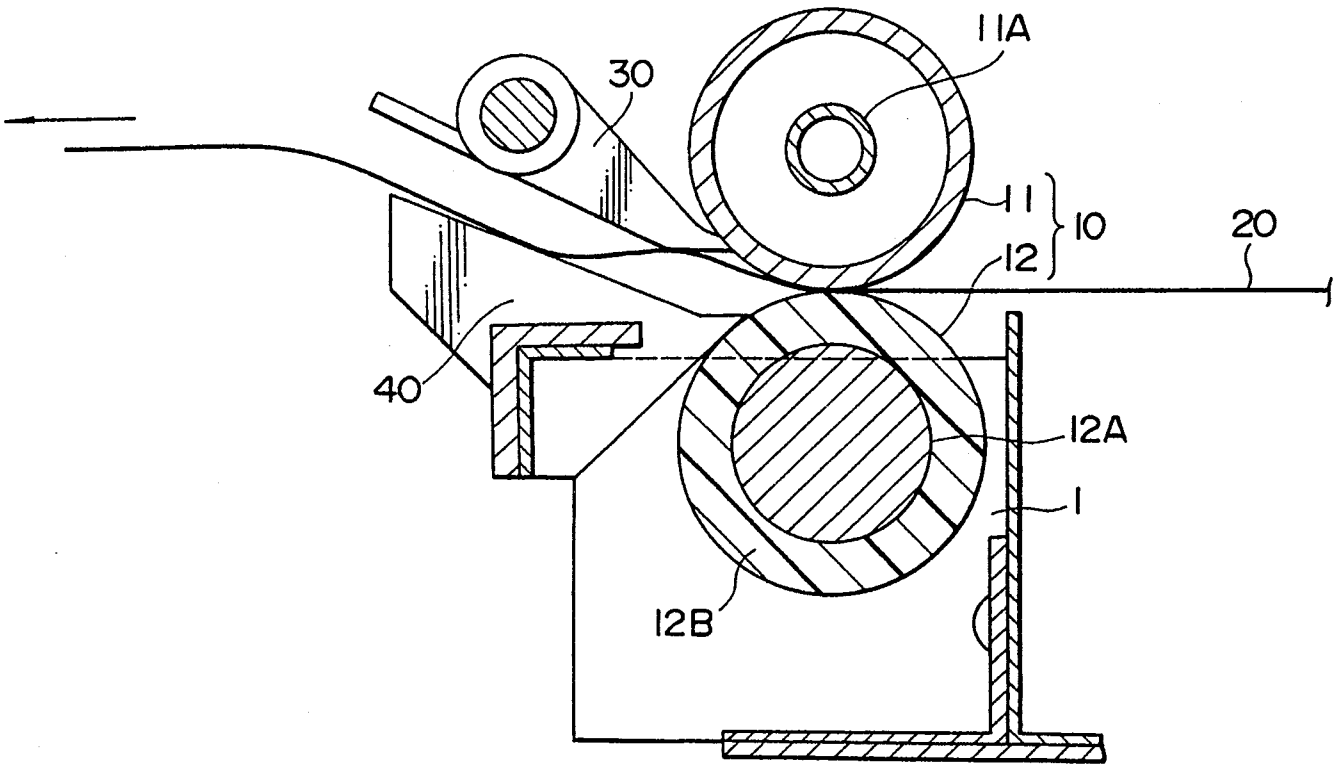
FIG. 2 is a cross sectional view of a heat roll fixing device embodying the present invention.

FIG. 2 is a cross sectional view of a heat roll fixing device according to a first embodiment of the present invention.

The fixing device shown in FIG. 2 is arranged such that a pair of fixing rollers 10, composed of a heat roller 11 and a back-up roller 12 on the upper and lower sides thereof, respectively, are adjacently disposed. The rotary axis of each of the pair of fixing rollers 10 extends in the width direction of a recording sheet 20 which is fed in the direction shown by an arrow in FIG. 2.

The heat roller 11 is a cylindrical roller having a halogen lamp 11A as a heating element inserted therein and heated to a predetermined temperature by the halogen lamp 11A. The opposite ends of the heat roller 11 are rotatably supported by a chassis 1 of the fixing device and the heat roller 11 is driven to rotate by a not shown gear fixed to one end of the heat roller 11.

The back-up roller 12 is a roller having a rubber layer 12B composed of silicone rubber or the like having a predetermined hardness formed around a core metal 12A, rotatably supported by the chassis 1 at the opposite ends thereof and pressed against the heat roller 11 by a predetermined pressure applied from a not shown spring.

An exfoliating claw 30 for exfoliating the recording sheet 20 from the heat roller 11 is provided on the sheet discharge side of the heat roller 11, and a paper discharge guide 40 as a guide member is provided on the sheet discharge side of the back-up roller 12.

The structure and output characteristics of the halogen lamp used in the fixing device according to the present invention arranged as described above, as well as the effect of the halogen lamp, will be described with reference to FIGS. 3A through 3D.

Figure 3A:
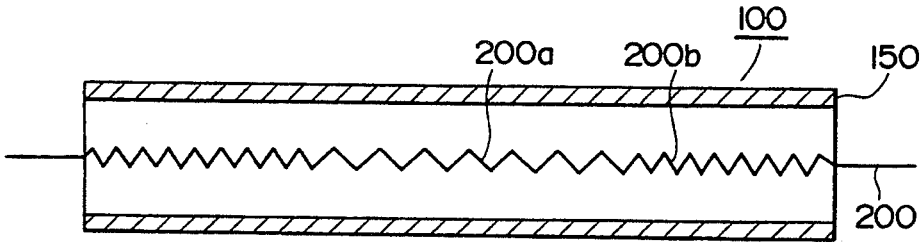
FIGS. 3A to 3D are diagrams showing the arrangement and operation of a halogen lamp used in the hear roll fixing device illustrated in FIG. 2.
Figure 3B:
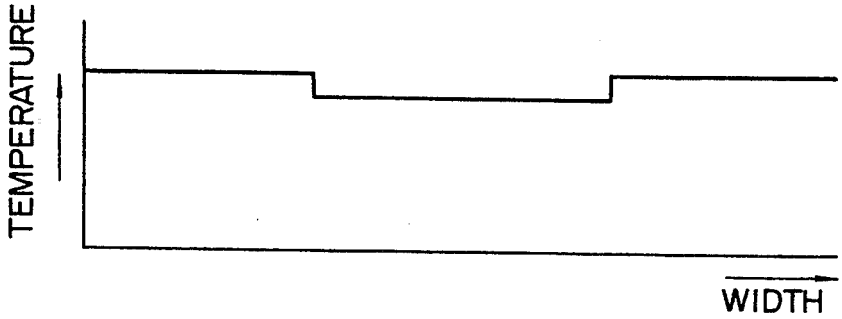
Figure 3C:
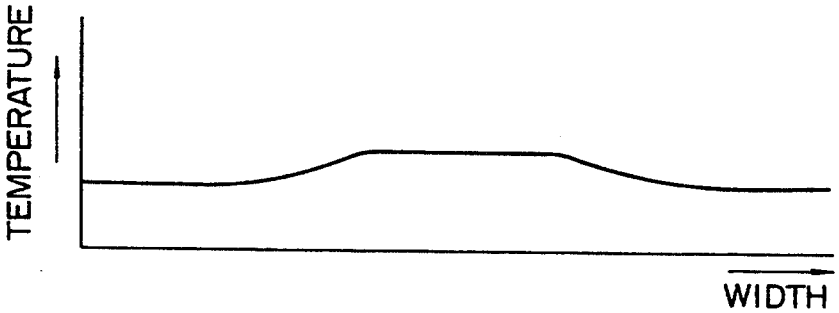

As shown in FIG. 3A, the heating element 200 in a halogen lamp 100 is arranged with dense portions 200*b* at the opposite ends thereof and a sparse portion 200*a* at the central portion thereof. The heating element 200 is provided with relatively higher density at the dense portions 200*b* than at the sparse portion 200*a*. Further, the difference between the density of the sparse portion 200*a* and that of the dense portion 200*b* is made relatively small. Therefore, as shown in FIG. 3B, the output distribution of the heating element 100 is set substantially flat, with the temperature being slightly lowered at the central portion. Since heat is radiated at the opposite ends of the heat roller 11 because it is attached to the chassis 1 at the ends, as shown in FIG. 3C, the heat roller 11 has a temperature distribution which is lower at the opposite ends thereof than at the central portion thereof as a whole. However, a temperature distribution as shown in FIG. 3C can be set by suitably adjusting the respective distributions and the difference of the densities of the sparse and dense portions of the heating element 200 of the halogen lamp 100. Note that in the first embodiment, the output of the heating element 200 at the opposite ends are set to be higher than that of the central portion by approximately 20 to 40%.

Figure 3D:
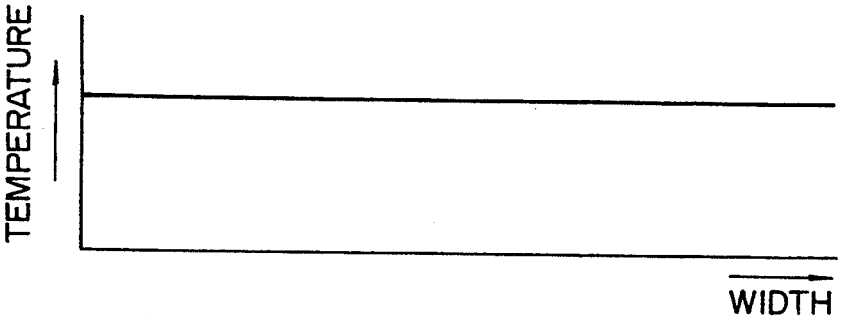

When a recording sheet 20 is fed, by using the heat roller 11 arranged as described above, while being pressed against the back-up roller 12, the back-up roller 12 has a temperature distribution as shown in FIG. 3D. More specifically, since the temperature of the back-up roller 12 is substantially uniformly distributed in the axial direction thereof when the recording sheet 20 is fed, the back-up roller 12 is uniformly expanded and deformed in the axial direction thereof. Therefore, a pressing force applied to the portion between the heat roller and the back-up roller where a fixing operation is carried out can be prevented from being lowered with the result that the deterioration of the fixing property and recording sheet feed capability can be prevented.

Figure 4:
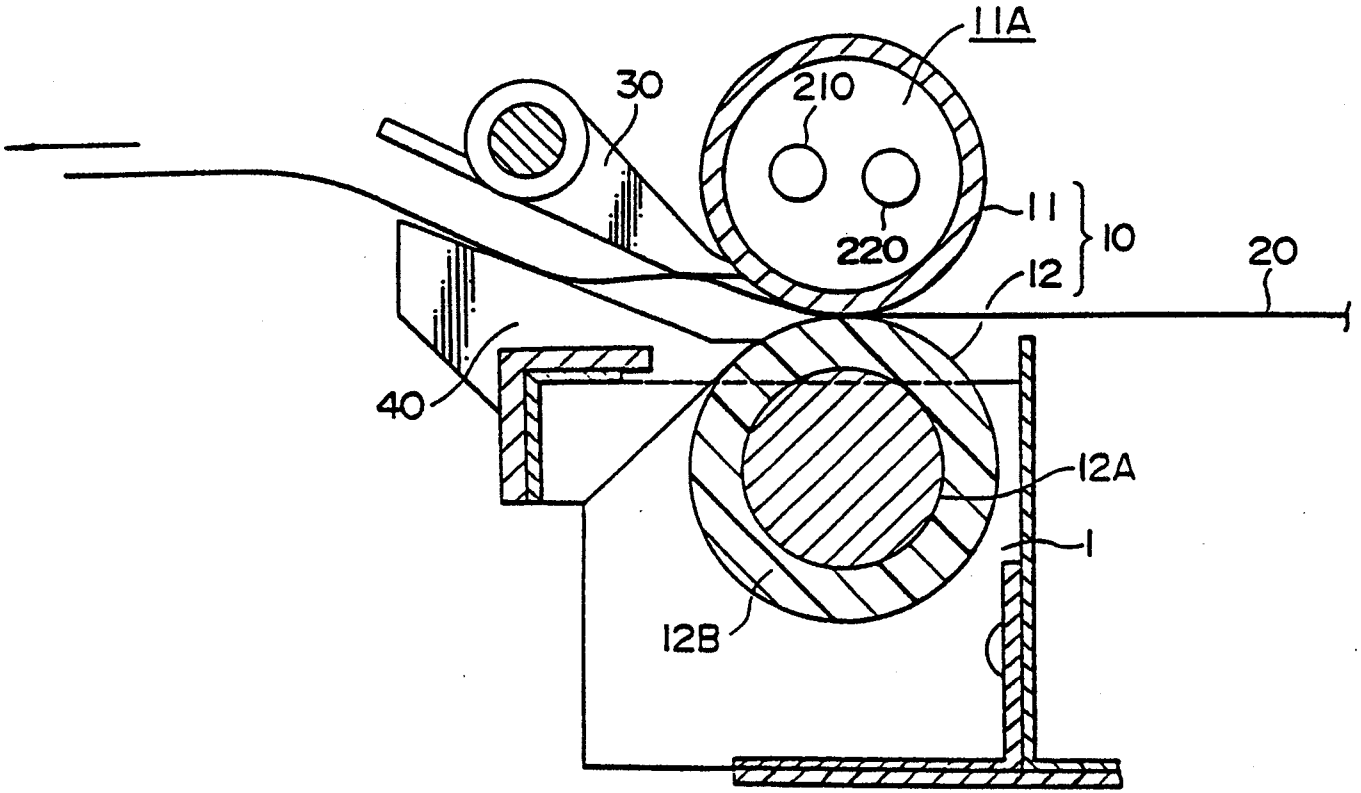
FIG. 4 is a cross sectional view of a second embodiment of a heat roll fixing device according to the present invention.

FIG. 4 is a cross sectional view of a second embodiment of a heat roll fixing device according to the present invention.

Figure 5:
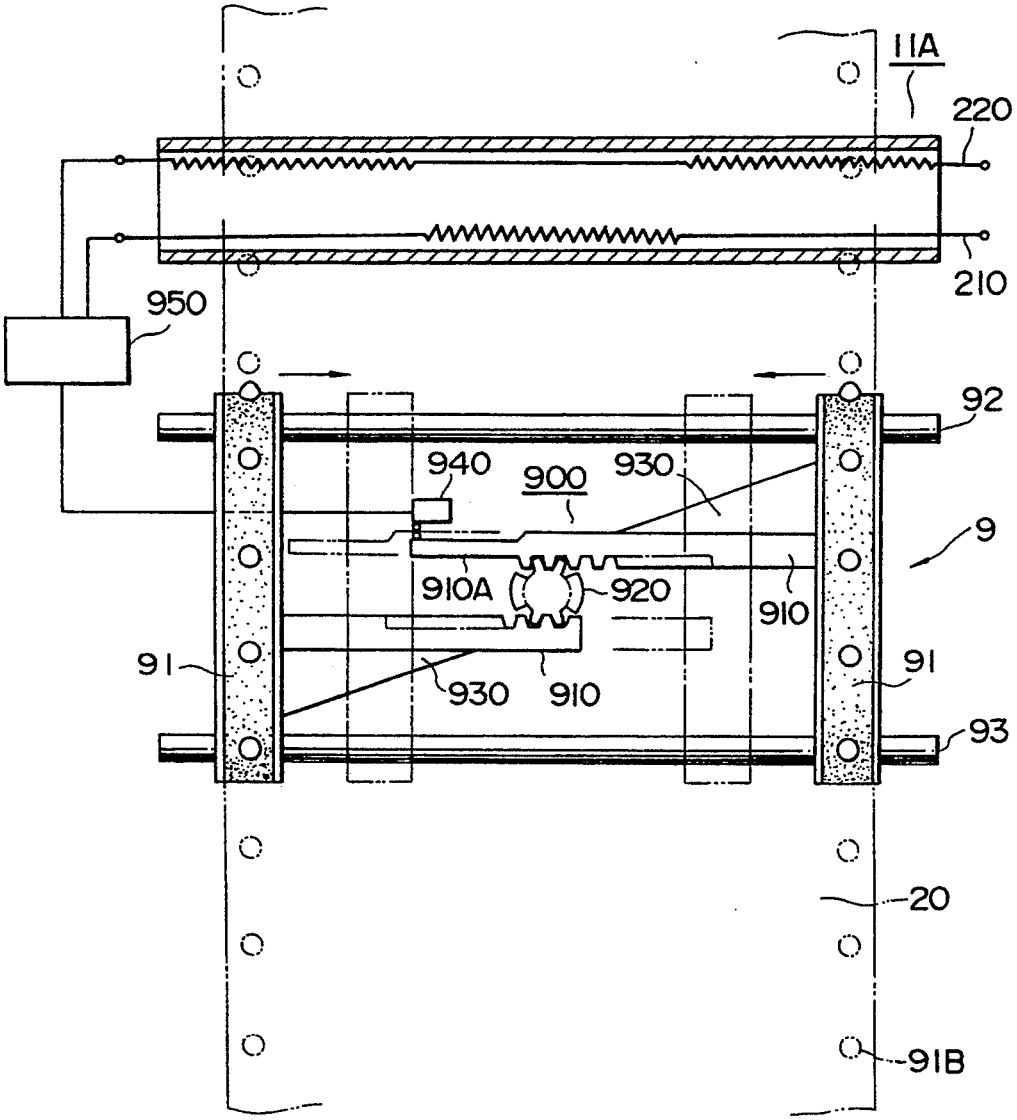
FIG. 5 is a diagram showing the arrangement of halogen lamps and a tractor used in the heat roll fixing device of FIG. 4, and the positional relationship thereof.

The arrangement of the fixing device shown in FIG. 4 is substantially the same as the first embodiment except that a lamp group 11A, including a pair of halogen lamps 210 and 220, are provided as a heating mechanism. The halogen lamps 210 and 220 have different heat distributions and are disposed in parallel with respect to the axial direction thereof, as shown in FIG. 5. Further, as shown in FIG. 5, a tractor 9 is disposed on the upstream side of a heat roller 11 having a lamp group 11A and composed of a pair of tractor belts 91, 91 disposed in parallel with respect to the feeding direction of the recording sheet 20. As the tractor belts 91, 91 are driven by a drive shaft 92 though a not shown drive source and rotated in the feeding direction of the recording sheet 20, a driven shaft 93 is also rotated in the feed direction of the recording sheet 20 to feed the recording sheet 20 by the cooperation of these shafts, so that the recording sheet 20 advances to the nip between the heat roller 11 and the back-up roller 12. Each of the tractor belts 91, 91 is provided with a plurality of projections 91A at predetermined intervals which are engaged with the feed holes 91B defined along the opposite side ends in the feed direction of the recording sheet 20. More specifically, as the tractor belts 91, 91 are rotated, the projections 91A engaged with the feed holes 91B are moved in the feed direction to feed the recording sheet 20.

Further, a well-known mechanism 900 for changing the width between the tractor belts 91, 91 is connected to the tractor 9 so that the width between the tractor belts 91, 91 can be substantially symmetrically changed in accordance with the width of the recording sheet 20 to be fed. The mechanism 900 is composed of a pair of racks 910, 910 disposed perpendicular to the feed direction of the recording sheet 20 and a rotatable pinion 910 having teeth which can be meshed with the gear portion of the racks 910, 910. The tractor belts 91, 91 are rotatable with respect to the respective shafts 92 and 93, and as shown by arrows in FIG. 5, they can move perpendicularly to the feed direction of the recording sheet 20. As a result, as the tractor belts 91, 91 are moved in the direction perpendicular to the sheet feed direction, the racks 910, 910 are moved and the pinion 920 is rotated. Further, ribs 930, 930 are disposed along the racks 910, 910 to prevent unnecessary vibration, dislocation and the like caused by the movement of the racks 910, 910.

A press member 910A is provided at the extreme end of one of the racks 910, 910 to turn on a switching member 940 composed of a microswitch or the like when the space between the tractor belts 91, 91 are narrowed. A switcher 950 composed of a well-known switching transistor circuit or the like is connected across the switching member 940 and the halogen lamp 11A and thus the halogen lamp 220 of the lamp group 11A is energized and heated depending upon the switching state of the switching member 940. In the second embodiment shown in FIG. 5, when the space between the tractor belts 91, 91 is wide, the heat roller 11 is heated by the halogen lamps 210 and 220, whereas when the space is narrow and the switching member 940 is turned on, the heat roller 11 is heated only by the halogen lamp 210. More specifically, the portion of the heat roller substantially corresponding to the width of the loaded recording sheet 20 is heated. In other words, the surface of the heat roller 11 corresponding to the portion thereof from which heat is absorbed by the recording sheet 20 pressed thereagainst is heated and thus when a narrow recording sheet is used, the opposite ends of the heat roller 11 are not heated. Therefore, heat is not transferred to the opposite ends of the back-up roller 12, so that the expansion of the opposite ends caused when they are unnecessarily heated can be prevented.

As a result, the deterioration of a toner fixing property and recording sheet feed property can be prevented when the recording sheet is pressed.

Note that in the second embodiment, although the recording sheet to be used can have two different widths and a predetermined one of the halogen lamps is heated depending upon the switching state of the switching member, the present invention is not limited to this arrangement but the printer may be constructed to detect a recording sheet having three or more kinds of width.

The present disclosure relates to subject matters contained in Japanese Utility Model Applications Nos. HEI 2-107804 and HEI 2-107805 (both filed on Oct. 15, 1990) which are expressly incorporated herein by reference in their entireties.

What is claimed is:

1. A fixing device comprising a heat roller and a back-up roller, having a predetermined axial length and defining a central portion and side portions each extending from said central portion along the axial length, said fixing device fusing an unfixed toner image carried on a recording sheet during a fixing operation, said sheet having a width less than the predetermined axial length of said back-up roller and contacting said central portion of said back-up roller, wherein said heat roller comprises heater means having an output at axial end portions of said heater means higher than at a central portion of said heater means, for heating a portion of said heat roller corresponding to a passing area of said recording sheet to a higher temperature than of the remaining portions of said heat roller when said rollers are separated, said remaining portions correspond to said side portions of said back-up roller, said heater means of said heat roller comprising means for ensuring that a temperature distribution of said back-up roller becomes substantially uniform along the axial length of said back-up roller while said recording sheet is passing between said heat roller and said back-up roller, and means for moving one of said heat roller and said back-up roller between positions contacting each other and spaced from each other, said heat roller and said back-up roller being in said contacting position during said fixing operation.

2. The fixing device according to claim 1, wherein said recording sheet is arranged to pass through the axial center portion of the fixing device and the temperature of the axial center portion of said heater means is set to be higher than both axial end portions thereof.

3. The fixing device according to claim 1, wherein said heating means comprises a halogen lamp extending along the axial direction of said heat roller, said lamp comprising a heat generating element that is arranged to be dense at the axial end portions of said heat roller and sparse at the axial central portion of said heat roller.

4. The fixing device according to claim 1, wherein said heating means comprises a plurality of heating elements arranged in parallel along the axial direction of said heat roller, said heating elements being arranged to partially heat predetermined axial areas of said heat roller, respectively.

5. The fixing device according to claim 1, wherein said heating means comprises at least a pair of heating elements arranged in parallel along the axial direction of said heat roller, one of said heating elements being arranged to heat the axial center portion of said heat roller and the other of said heating elements being arranged to heat the axial end portions of said heat roller.

6. A heat roller employed in an electrophotographic imaging apparatus in connection with a back-up roller for fusing an unfixed toner image carried on a recording sheet during a fixing operation, said recording sheet having a width less than the width of the back-up roller, said heat roller comprising heater means, having an output at axial end portions of said heater means higher than at a central portion of said heater means, for heating a portion of said heat roller corresponding to a passing area of said recording sheet to a higher temperature than that of the remaining portions of said heat roller when said back-up roller is separated from said heat roller, said heater means of said heat roller comprising means for ensuring that a temperature distribution of said back-up roller is substantially uniform along an axial direction of said heat roller, while said recording sheet is passing between said heat roller and said back-up roller, said back-up roller and said fixing roller being in a contacting position during said fixing operation, and being mounted for movement to a separated position.

7. A fixing device comprising a heat roller and a back-up roller, said back-up roller having a predetermined axial length defining a central portion and side portions each extending from said central portion, said fixing device fusing an unfixed toner image carried on a recording sheet during a fixing operation, said recording sheet having a width less than the predetermined axial length of said back-up roller and contacting said central portion of said back-up roller, said heat roller comprising heater means installed therein for heating said heat roller, said fixing device being able to load various types of recording sheets having different widths, wherein said heater means comprises a plurality of heating elements arranged in parallel along the axial direction of said heat roller and having an output at axial end portions of said heater means higher than at a central portion of said heater means, said heating elements being arranged to partially heat predetermined axial areas of said heat roller, respectively, so that, when said rollers are in a non-contacting position, the temperature of a portion of said heat roller corresponding to a passing area of the recording sheet is higher than that of the remaining portions of said heat roller by selectively actuating said plurality of heating elements depending upon the width of the recording sheet being loaded, said heating means within said heat roller comprising means for ensuring that a temperature distribution of said back-up roller becomes substantially uniform along its axial direction while the recording sheet is passing between said heat roller and said back-up roller, regardless of the width of the recording sheet to be loaded, said back-up roller and heat roller being in a contacting position during said fixing operation, at least one of said roller mounted for movement to a non-contacting position.

8. The fixing device according to claim 7, further comprising:

detecting means for detecting the width of the recording sheet loaded; and selecting means for selecting the heating elements to be operational depending upon the result of the detection by said detecting means.

9. The fixing device according to claim 8, wherein said detecting means comprises a pair of guide members arranged in parallel in the feed direction of said recording sheet, the interval between said guide members being able to change in accordance with the width of the recording sheet loaded.

10. The fixing device according to claim 7, wherein said heater means comprises a halogen lamp extending in the axial direction of said heat roller, and said heating elements comprise heat generating elements installed therein.

11. A fixing device comprising a heat roller and a back-up roller, said back-up roller having a predetermined axial length and defining a central portion and side portions each extending from said central portion along the axial length, said fixing device fusing an unfixed toner image carried on a recording sheet during a fixing operation, said sheet having a width less than the predetermined axial length of said back-up roller and contacting said central portion of said back-up roller, said heat roller comprising heater means installed therein for heating said heat roller, said heater means having an output at axial end portions of said heater means higher than at a central portion of said heater means, said fixing device being able to load at least two types of recording sheets having different widths, said heater means comprises at least a pair of heating elements arranged in parallel along the axial direction of said heat roller, one of said heating elements being arranged to partially heat a principle portion of said heat roller corresponding to a passing area of a predetermined one of said types recording sheets, the other of said heating elements being arranged to heat the remaining portions of said heat roller, said heater means comprising means for heating a portion of said heat roller corresponding to a width of a sheet to a higher temperature than of remaining portions of said heat roller when said heat roller is in a non-contacting position with respect to said back-up roller; and wherein said other one of said heating elements is actuated only when a recording sheet loaded is other than said predetermined type of said recording sheets, said heater means within said heat roller comprising means for ensuring that a temperature distribution of said back-up roller is substantially uniform along the axial direction of said heat roller when said recording sheets pass between said heat roller and said back-up roller, regardless of the type of said recording sheets, said heat roller and back-up roller contacting each other during said fixing operation and being mounted for movement to a non-contacting position.

12. The fixing device according to claim 1, said heating means being positioned exclusively in said heat roller.

13. The heat roller according to claim 6, said heater means being positioned exclusively within said heat roller.

14. The fixing device according to claim 7, said heater means being positioned exclusively within said heat roller.

15. The fixing device according to claim 11, said heater means being positioned exclusively within said heat roller.

* * * * *

UNITED STATES PATENT AND TRADEMARK OFFICE

CERTIFICATE OF CORRECTION

PATENT NO. : 5,355,203

DATED : October 11, 1994

INVENTOR(S) : T. NISHIKAWA et al.

It is certified that error appears in the above-indentified patent and that said Letters Patent is hereby corrected as shown below:

On the Title Page section (56), under U.S. Patent Documents, insert ---5,070,231 12/1991 Bacus et al. 219/216---.

At column 8, line 39 (claim 7, line 37), "roller" should be changed to ---rollers---.

Signed and Sealed this

Thirtieth Day of May, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,355,203
DATED : October 11, 1994
INVENTOR(S) : Tomoyuki NISHIKAWA et al.

It is certified that error appears in the above-indentified patent and that said Letters Patent is hereby corrected as shown below:

On the Title page, item [73]; Assignee, line 1, change "Kogyokabushiki" to ---Kogyo Kabushiki---.

Signed and Sealed this

Third Day of September, 1996

*Attest:*

Bruce Lehman

BRUCE LEHMAN

*Attesting Officer*

*Commissioner of Patents and Trademarks*